US005261371A

United States Patent [19]

Sumida et al.

[11] Patent Number: 5,261,371

[45] Date of Patent: Nov. 16, 1993

[54] IDLING REVOLUTION NUMBER CONTROL VALVE FOR AN INTERNAL COMBUSTION ENGINE

[75] Inventors: Mamoru Sumida; Osamu Matsumoto, both of Himeji, Japan

[73] Assignee: Mitsubishi Denki Kabushiki Kaisha, Tokyo, Japan

[21] Appl. No.: 5,180

[22] Filed: Jan. 15, 1993

Related U.S. Application Data

[63] Continuation of Ser. No. 825,261, Oct. 24, 1992, abandoned.

[30] Foreign Application Priority Data

Mar. 20, 1991 [JP] Japan ..... 3-055409

[51] Int. Cl.[5] ..... F02M 3/00

[52] U.S. Cl. ..... 123/339; 251/129.01

[58] Field of Search ..... 123/339; 251/129

[56] References Cited

U.S. PATENT DOCUMENTS 4,161,306 7/1979 Brune et al. ..... 251/129
4,989,564 2/1991 Cook et al. ..... 123/339
5,042,448 8/1991 Cook et al. ..... 123/339

FOREIGN PATENT DOCUMENTS 63-21746 2/1988 Japan ..... 123/339

*Primary Examiner*—Raymond A. Nelli
*Attorney, Agent, or Firm*—Sughrue, Mion, Zinn, Macpeak and Seas

[57] ABSTRACT

An idling speed control valve for an internal combustion engine is disposed bypassing a throttle valve arranged at an intake passage of the engine, and proportionally controls the quantity of air flowing in the bypass passage based on an output of an electronic control unit including an idling revolution number control function. The valve is controlled by an electromagnetic coil of a solenoid device, and the coil is made of a brass series alloy wire material.

2 Claims, 5 Drawing Sheets

IDLING REVOLUTION NUMBER CONTROL VALVE FOR AN INTERNAL COMBUSTION ENGINE

This is a continuation of application Ser. No. 07/825,261 filed Jan. 24, 1992.

BACKGROUND OF THE INVENTION

1. Field of the Invention

This invention relates to an idling revolution number control valve which is provided at an intake passage of an internal combustion engine, and particularly to a linear solenoid which drives the valve by electromagnetic force.

2. Discussion of Background

Conventionally, almost all of the idling revolution number control valves for an internal combustion engine are driven by a solenoid utilizing electromagnetic force or by a motor. Copper wires are utilized for the electromagnetic coil which generates magnetomotive force in these electromagnetic actuators. Among these, especially, many of the idling revolution number control valve-with linear solenoid drivers, have an idling control function wherein the idling revolution number of an automobile is stabilized, an idling speed-up function wherein lowering of the idling revolution number is corrected corresponding to an electrical load or an air conditioner load, and a fast idling function wherein the idling revolution after the starting-up of the engine in cold temperature is maintained and warming-up of the engine is accelerated. Therefore, the required flow quantities of air are different under various conditions. It is important to flow the required quantity of air corresponding to these conditions, by performing an operation which complies with a direction from an electronic control unit (hereinafter ECU).

However, when a solenoid is utilized as a driver, its coil resistance is increased by the temperature elevation of the coil when electric current flows. When electric voltage corresponding to a battery voltage is applied to the solenoid to activate it, the coil temperature is elevated above normal, current flow is decreased, force generated by the solenoid is reduced, and a target flow quantity of air can not be achieved. For instance, a relationship between a solenoid terminal voltage and the coil resistance when the coil temperature is set at 23° C. and 80° C., is shown in the following equations.

$$I_{23}=E_B/R_{23},$$

$$I_{80}=E_B/R_{80},$$

where $I_{23}$ is an average current at 23° C., $E_B$, the solenoid terminal voltage, $R_{23}$, the coil resistance at 23° C., $I_{80}$, the average current at 80° C., and $R_{80}$, the coil resistance at 80° C.

Furthermore, since $R_{80}>R_{23}$ from the above relationship, $I_{80}<I_{23}$. Since the magnetomotive force of the solenoid is determined by a turn number of the coil, N and the flow current, I, therefore, $NI_{80}<NI_{23}$. Since the force generated by the solenoid is reduced due to the above relationship, even under the same terminal voltage, the target flow quantity of air is not achieved.

Furthermore, in the linear solenoid valve of this kind, a duty control wherein the current to the electromagnetic coil intermittently flow at a certain frequency, and a movable iron core is slid finely by changing a ratio between ON time and OFF time of the current, or a dither control wherein the movable iron core is finely slid, in which a certain DC voltage is provided with a variation (AC component), is generally utilized.

For instance, when a rated voltage which is applied to the linear solenoid is determined to be 12V as a reference, in case of the duty control, the applied voltage to the electromagnetic coil is 12V in case of the duty ratio of 100%. In case of the duty ratio of 50%, a mean applied voltage is 6V. The target flow quantity is determined corresponding to the duty ratio, since the position of the movable iron core is determined corresponding with these values. When the voltage applied to the linear solenoid is changed by a variation of the battery voltage, the target flow quantity can be obtained by changing the duty ratio so that the variation is corrected. To obtain the same flow quantity the correction is performed by the following equation.

$$D_{EV}=D_{12V}\times 12/E$$

where E is the terminal voltage of the linear solenoid, $D_{EV}$, the duty for the terminal voltage E(V), and $D_{12V}$, the duty for the terminal voltage 12V. The correction with respect to the coil temperature of the solenoid can be considered in the same way. For instance, when a coil resistance $R_{20}$ at 20° C. is determined as a reference, a coil resistance $R_t$ at t° C. is shown by the following equation.

$$R_t=R_{20}\times\{1+\alpha(t-20)\},$$

where $\alpha$ is temperature coefficient of resistance (1/deg) of copper wire. Accordingly, when the coil temperature is at t° C., to obtain the flow quantity which is the same as that at 20° C., the correction is to be performed by the following equation.

$$D_t=D_{20}\times R_t/R_{20},$$

where $D_t$ is the duty at t° C., and $D_{20}$, the duty at 20° C.

When the linear solenoid is utilized in the idling revolution number control, normally, the above correction with respect to the voltage or the temperature is performed. Especially in case of the correction with respect to the coil temperature, a method wherein the duty ratio is corrected by detecting the value of the electric current which flows in the coil, causes an increase of size of the ECU or an increase of production cost. Therefore a method is much used wherein a portion in which cooling water of the engine is flown adjacent to outside of the coil of the linear solenoid is provided, the coil temperature is equalized with a cooling water temperature of the engine, and the coil temperature is represented by the cooling water temperature which is detected by a cooling water temperature sensor (normally always equipped). In this case, to improve thermal transfer between the coil and the cooling water, an outer structure of the linear solenoid is made by aluminum die casting or the like, wherein a cooling water passage is constructed, and a space among the aluminum die casting structure, the coil and magnetic circuit parts, is filled with resin or the like.

FIG. 5 shows a construction diagram of the conventional idling revolution number control valve, wherein a reference numeral 1 designates a solenoid case made by the aluminum die casting, 2, a fixed iron core, 3, a case which accommodates a magnetic circuit, 4, a movable iron core, 5, a return spring which pushes the movable iron core to the reverse side of the fixed iron core 2, 6, an electromagnetic coil which is provided outside of the fixed iron core 2 and the movable iron core 4, and 6*b*, a takeout wire provided from the electromagnetic coil 6 to the outside thereof. A reference numeral 4*b* designates a through hole which penetrates the central portion of the movable iron core 4, 14, a valve which is provided at the back end of the movable iron core 4, and 13, a valve seat which is utilized in opening and closing operations of the valve 14.

A reference numeral 11 designates a main body of the idling revolution number control valve, 9, a spring holder which is fixed to the main body 11 through an attaching screw 10, 8, a spring which is provided to the movable iron core 4 through a holder 16 or the like, 15, a spring provided between the movable iron core 4 and the valve 14, 11*a*, a fluid flow-in passage, 11*c*, a fluid flow-out passage, and 11*b*, a fluid chamber which communicates both passages 11*a* and 11*c*. A reference numeral 20 designates a cooling water passage which is formed in the solenoid case 1. FIG. 6 shows a construction diagram of another example of the conventional idling revolution number control valve, wherein since the construction is the same as in FIG. 5, the same notations are given thereto and further explanation is omitted.

Since in the conventional idling revolution number control valve, the solenoid case 1 is made of the aluminum die casting structure and the cooling water passage 20 is provided therein, it is difficult to downsize it and the production cost thereof is high. The shape of the cooling water passage which is composed by the aluminum die casting structure depends on the kinds of vehicles due to piping layouts thereof. Therefore a matching of the coil temperature and the cooling water temperature causes an increase in production steps in development of a new model car.

Furthermore, it is normally important to correct the change of the coil temperature in driving the valve in an idling state of the engine after the warming-up of the engine. Moreover, the cooling water passage of the aluminum die casting structure is not utilized under a condition wherein flow quantity accuracy is not required.

SUMMARY OF THE INVENTION

It is an object of the present invention to solve above problems. It is an object of the present invention to provide an idling revolution number control valve for an internal combustion engine capable of simply correcting the duty ratio corresponding with change of the coil temperature, without providing the cooling water passage of the engine in a case of the linear solenoid, by which the downsizing thereof and the cost reduction thereof are aimed, also by utilizing the current ECU as it is.

According to an aspect of the present invention, there is provided an idling revolution number control valve for an internal combustion engine, provided at a bypass passage which bypasses a throttle valve arranged at an intake passage of the internal combustion engine, and proportionally controls a flow quantity of air flowing in the bypass passage based on an output of an electronic control unit including an idling revolution number control function characterized in that: an electromagnetic coil of a solenoid device composing a control valve for the idling revolution number control function for the internal combustion engine is made of a brass series alloy material.

Since the temperature coefficient of resistance of the brass series alloy is about a third of that of pure copper, heat generation when current flows through the coil is small, and the coil temperature can almost be equalized to the cooling water temperature after the warming-up of the engine in the idling state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
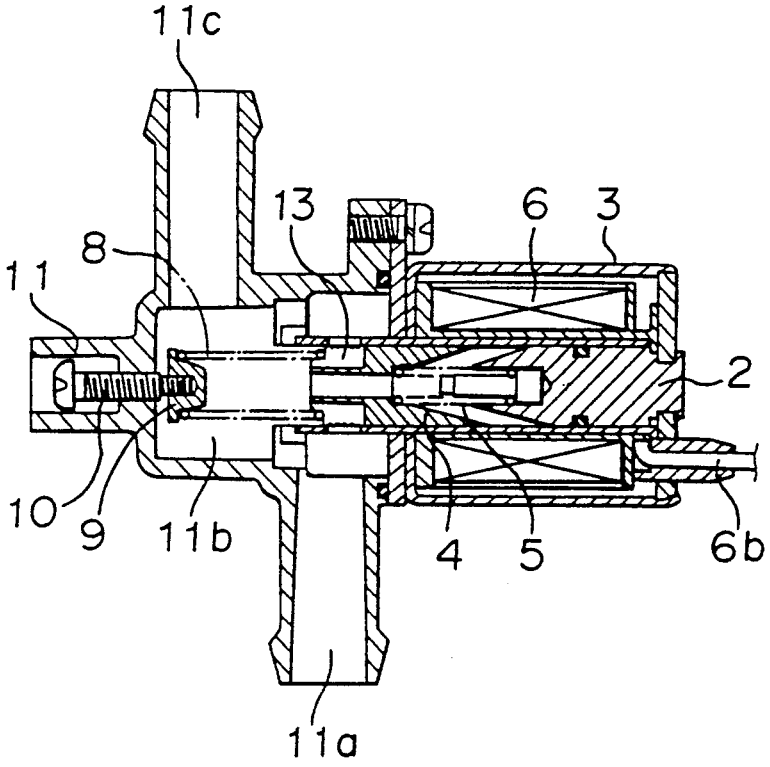
FIG. 1 is a construction diagram showing an Example of an idling revolution number control valve according to the present invention.
Figure 2:
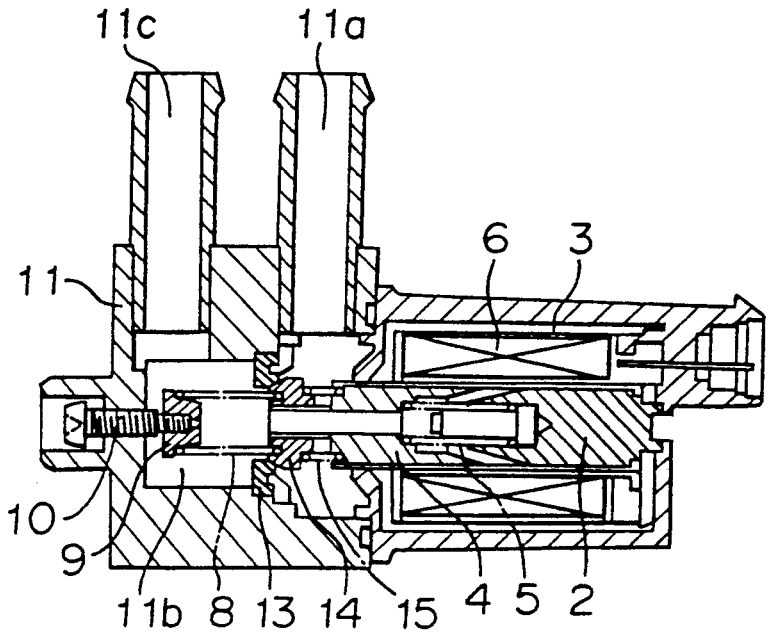
FIG. 2 is a construction diagram of another Example of an idling revolution number control valve according to the present invention.
Figure 5:
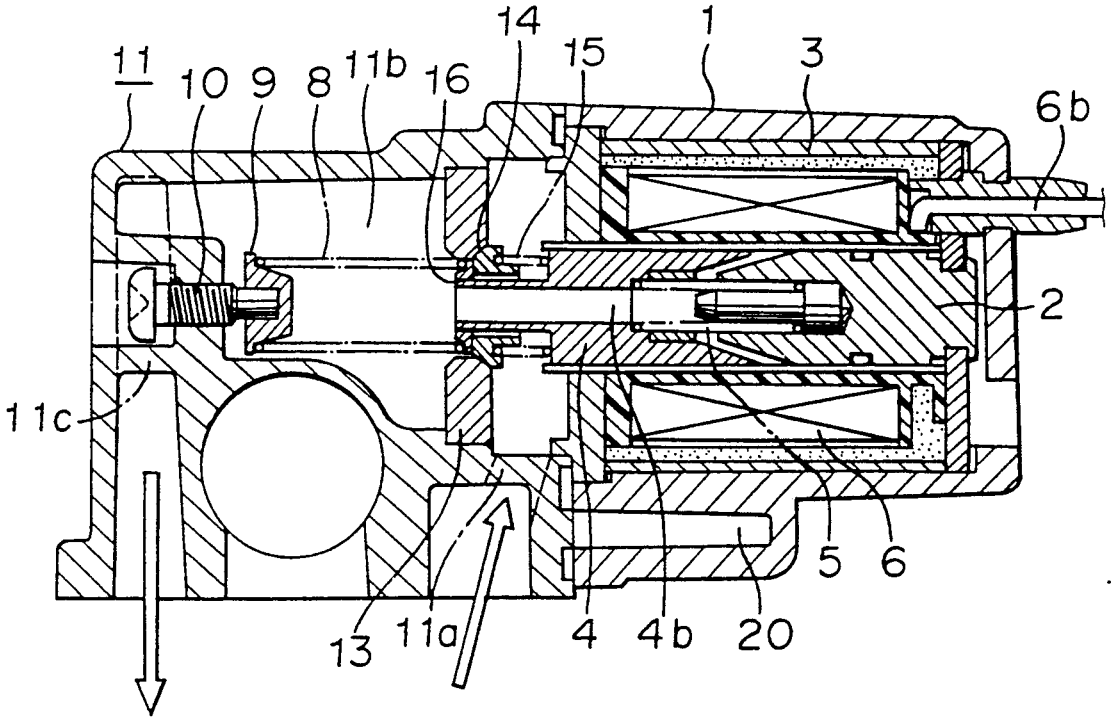
FIG. 5 is a construction diagram of the conventional idling revolution number control valve.
Figure 6:
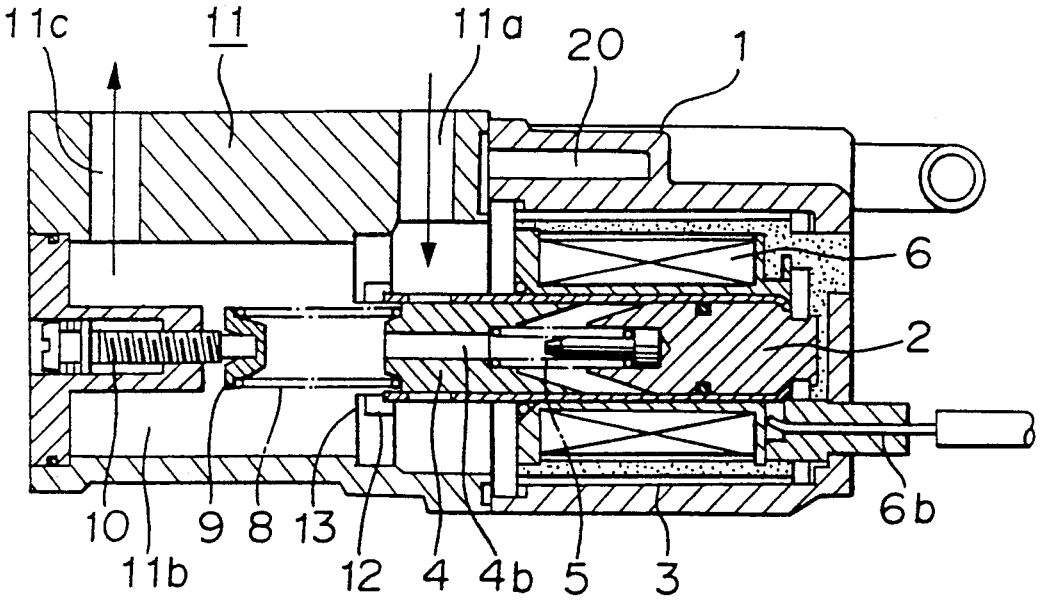
FIG. 6 is a construction diagram of another example of the conventional idling revolution number control valve.

An embodiment of the present invention will be explained referring to the drawings as follows. FIGS. 1 and 2 respectively show construction diagrams of an idling revolution number control valve for an internal combustion engine according to the present invention, wherein the respective notations are the same as those of the conventional idling revolution number control valve which is explained in FIG. 5. The point different with the conventional Example is that the electromagnetic coil 6 of the solenoid device is made of a brass series alloy.

Next, a detailed explanation will be given to the reason wherein the electromagnetic coil 6 is made of the brass series alloy. The temperature coefficient of resistance of the coil wire material is $4.3\times10^{-3}$/deg for copper, and $1.7\times10^{-3}$/deg for brass, and relative conductivities of copper and brass are copper:-brass = 100:26. Accordingly, the wire size and length of the coil are to be investigated, under a condition wherein the current resistance value and winding space of the coil remains the same in both materials. In this occasion, since the conductivity of the brass series alloy is about a quarter of that of copper, the resistance value of the brass coil per unit length is four times as much as that of the copper coil. When the coil resistance remains the same, the turn number of the coil is considerably reduced and the AT (ampere turn) which is the magnetomotive force, is lowered. Therefore it is necessary to investigate the wire size and the length of the coil in a range wherein the lowered portion of the AT is compensated by improving a magnetic circuit thereof.

In the above investigation, firstly, the coil resistance is to be a value which is comparable to or a little larger than the current coil. Secondly, the coil wiring space is to be comparable to the current coil. Thirdly, the wire size of the coil is increased and the length thereof is decreased. Fourthly, the AT or the turn number is to be lowered to half to a third of the current coil. Fifthly, the suction force of the linear solenoid having the same AT as in the current coil is to be twice to thrice of the current coil.

Under these conditions, the linear solenoid made of brass wires can be composed with the same function as in the current coil. Concerning the fifth condition, since the current linear solenoid is constituted by composing a magnetic circuit wherein an available suction force is decreased, it is possible to improve the magnetic circuit so that the suction force is increased to twice to thrice of that in the current coil. However, when the suction force is required to be increased more than the above range, a function wherein the change of the suction force versus air gap (stroke of the movable iron core) is linearized, which is the characteristic of the linear solenoid, is lost.

Figure 3:
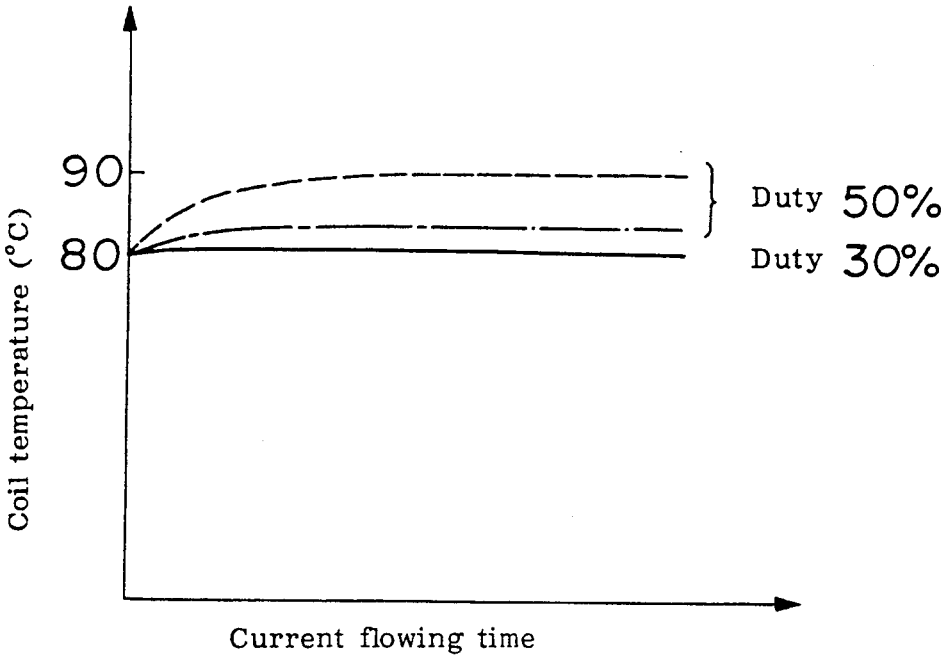
FIG. 3 is a characteristic diagram of a saturated temperature of the coil when the linear solenoid is composed by brass wires.
Figure 4:
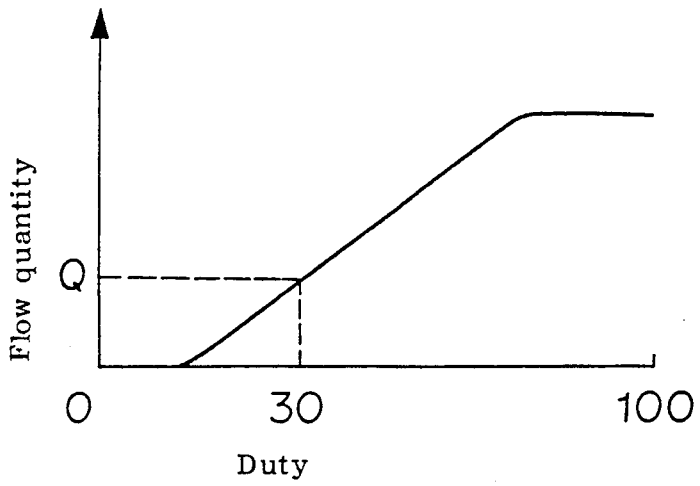
FIG. 4 is a representative characteristic diagram of the idling revolution number control valve.

FIG. 3 shows a characteristic diagram of a saturated temperature of the coil when the linear solenoid is composed of the brass wires, and FIG. 4 shows a representative characteristic diagram of the idling revolution number control valve. Normally the most used domain for a duty of the coil is set around 30% in its duty. Therefore, when the cooling water temperature of the engine after the warming-up of the engine, is determined to be about 80° C., no trouble is caused in the normal idling revolution number control, if the coil temperature is about 80° C. even in case of continuous current flowing wherein the duty reaches the neighborhood of 50%, which is set in consideration of a temperature allowance. In FIG. 3, when ambient temperature is 80° C., the cooling water at 80° C. is flowing in the current copper coil, and no cooling water is flowing in the brass coil. The broken line in FIG. 3 designates the characteristic of the current coil at the duty of 50%, one dotted chain line, that of the brass coil at the duty of 50%, and the bold line, those of the current coil and the brass coil at the duty of 30%. As shown in FIG. 3, the coil temperature of the current coil is about the same with the cooling water temperature at the duty of 30%, however, at the duty of 50%, there is a difference of about 10 degrees between them.

On the other hand, in the case of the brass coil, the difference between the coil temperature and the ambient temperature is lowered by below 10 degrees at the duty of around 50% even with no flowing of the cooling water.

As explained above, in this invention, since the electromagnetic coil of the solenoid device is made of a brass series alloy, it is possible to dispense with the cooling water passage of the engine, the device is downsized, and the cost is reduced. Furthermore, the increase of development steps which are required in matching of the coil temperature and the cooling water temperature, can be dispensed with. Since the ECU remains the same as in the current copper coil, the current control can be performed. Therefore reduction of the production steps and the cost reduction can be realized as for the total of the device.

Obviously, numerous modifications and variations of the present invention are possible in light of the above teachings. It is therefore to be understood that within the scope of the appended claims, the invention may be practiced otherwise than as specifically described herein.

What is claimed is:

1. An idling revolution number control valve for an internal combustion engine, said valve being disposed in a passage which bypasses a throttle valve arranged in an air intake passage of the internal combustion engine, and proportionally controlling the quantity of air flowing in the bypass passage based on an output of an electronic control unit including an idling revolution number control function, said valve comprising:

a linearly movable valve control member, an electromagnetic actuating coil surrounding the control member, and means for avoiding a performance degradation of the control valve due to $I^2R$ heating of the coil, said avoiding means comprising:

a) said coil being made of a brass series alloy wire material having a temperature coefficient of resistance less than one-half that of copper and an electrical conductivity less than one-third that of copper, and b) said coil wire having a greater diameter tan a comparable copper wire coil and a shorter length than a comparable copper wire coil such that said brass series alloy wire coil occupies substantially the same space as a comparable copper wire coil and has substantially the same resistance as a comparable copper wire coil.

2. A control valve according to claim 1, wherein the temperature coefficient of resistance of the coil wire is approximately $1.7\times10^{-3}$ degrees.

* * * * *